US007963323B2

(12) United States Patent
Bailey

(10) Patent No.: US 7,963,323 B2
(45) Date of Patent: Jun. 21, 2011

(54) TECHNIQUE AND APPARATUS TO DEPLOY A CEMENT PLUG IN A WELL

(75) Inventor: Louise Bailey, Cambridgeshire (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 330 days.

(21) Appl. No.: 11/951,471

(22) Filed: Dec. 6, 2007

(65) Prior Publication Data

US 2009/0145601 A1 Jun. 11, 2009

(51) Int. Cl.
*E21B 47/00* (2006.01)

(52) U.S. Cl. ..... 166/250.03; 166/250.01; 166/285; 166/305.1; 166/250.04; 166/66

(58) Field of Classification Search ..... 166/285, 166/305.1, 250.04, 250.01, 66, 250.03
See application file for complete search history.

(56) References Cited

U.S. PATENT DOCUMENTS

| | | | | |
|---|---|---|---|---|
| 5,027,900 | A | 7/1991 | Wilson | |
| 6,012,744 | A | 1/2000 | Wilson et al. | |
| 6,176,323 | B1 | 1/2001 | Weirich et al. | |
| 6,670,880 | B1 | 12/2003 | Hall et al. | |
| 7,066,256 | B2 * | 6/2006 | Dillenbeck et al. | 166/255.1 |
| 7,207,396 | B2 | 4/2007 | Hall et al. | |
| 7,219,747 | B2 | 5/2007 | Gleitman et al. | |
| 2003/0029611 | A1 * | 2/2003 | Owens | 166/250.03 |
| 2005/0194182 | A1 * | 9/2005 | Rodney et al. | 175/24 |
| 2005/0194184 | A1 | 9/2005 | Gleitman | |
| 2005/0200498 | A1 | 9/2005 | Gleitman | |
| 2005/0279532 | A1 | 12/2005 | Ballantyne et al. | |
| 2005/0284659 | A1 | 12/2005 | Hall et al. | |
| 2006/0086502 | A1 * | 4/2006 | Reddy et al. | 166/291 |
| 2006/0196695 | A1 | 9/2006 | Giroux et al. | |
| 2006/0225926 | A1 | 10/2006 | Madhavan | |

FOREIGN PATENT DOCUMENTS

| | | |
|---|---|---|
| GB | 2431942 | 5/2007 |
| WO | W09419574 | 9/1994 |
| WO | 2007070805 | 6/2007 |

* cited by examiner

*Primary Examiner* — Jennifer H Gay
*Assistant Examiner* — Yong-Suk Ro
(74) *Attorney, Agent, or Firm* — David J. Smith; Dave R. Hofman

(57) ABSTRACT

A technique that is usable with a well includes deploying a sensing device on a drill string and communicating with the sensing device during a plug cementing operation over a wired infrastructure of the drill string. The technique includes controlling the plug cementing operation in response to the communication.

20 Claims, 6 Drawing Sheets

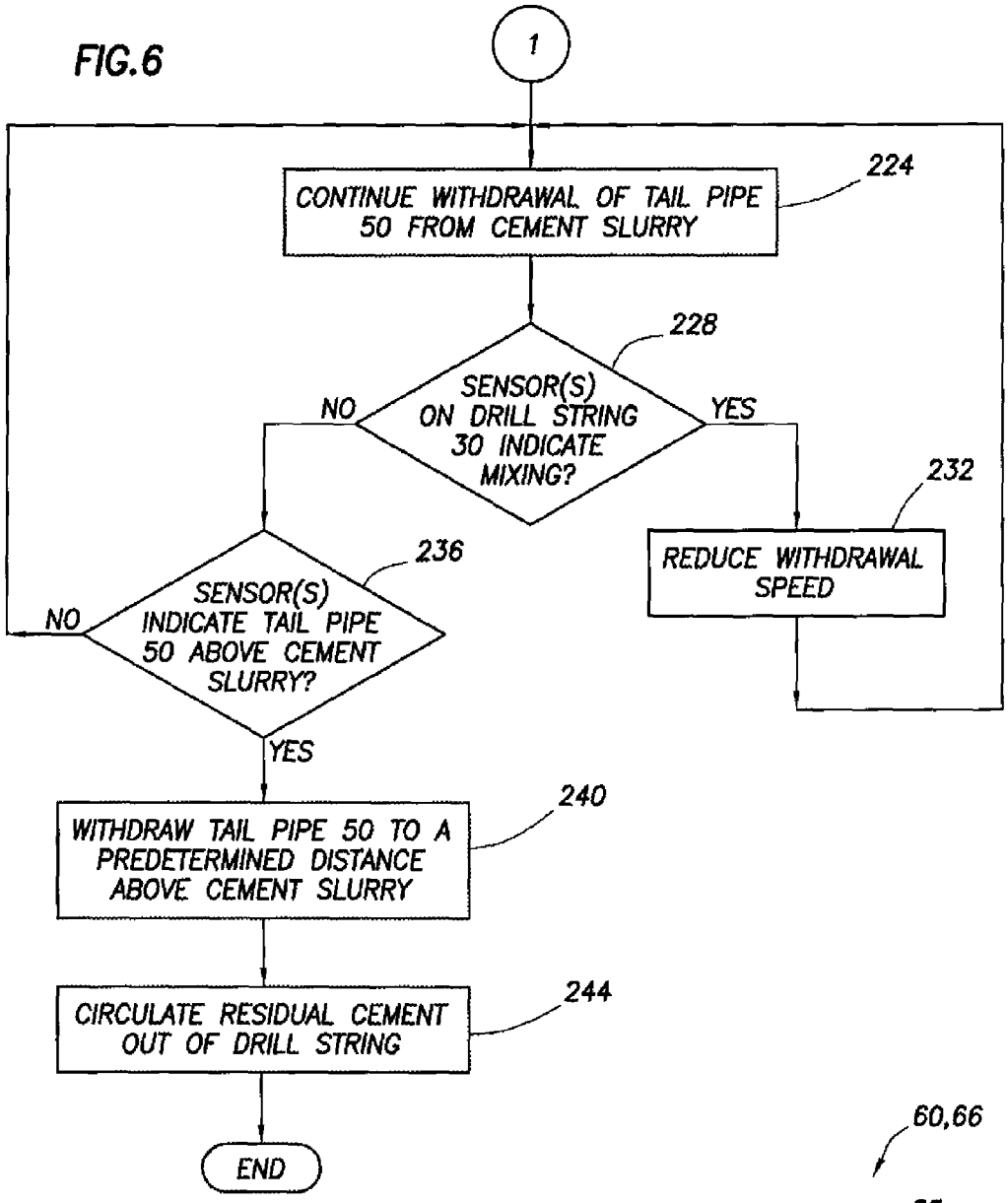
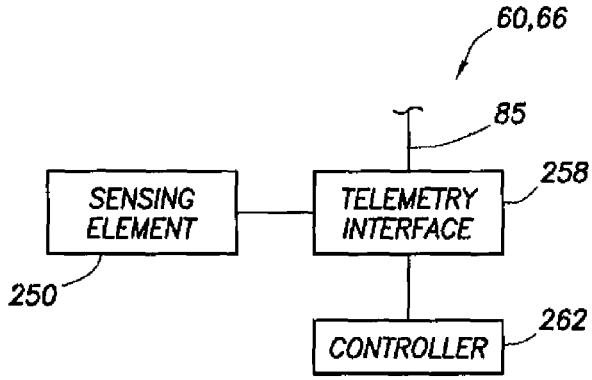
FIG.7

TECHNIQUE AND APPARATUS TO DEPLOY A CEMENT PLUG IN A WELL

BACKGROUND

The invention generally relates to a technique and apparatus to deploy a cement plug in a well.

A cement plug may be deployed in a subterranean oil or gas well for a variety of different reasons. For example, a cement plug may be placed in the well to seal off a lost circulation zone, kick off a side track or initiate directional drilling. Additionally, a cement plug may be set in the well to temporarily seal and protect a formation or seal the well for abandonment.

Plug cementing typically includes communicating a predetermined amount of cement slurry into a wellbore through a drill string and allowing the cement slurry to set. Mechanical or fluid spacers may be pumped before and after the cement slurry through the drill string for purposes of isolating the cement slurry from drilling fluid. Uncertainties associated with the plug cementing operation, such as imprecise knowledge of the volume of cement slurry pumped and the exact wellbore volume into which the cement slurry is pumped, may adversely affect the plug cementing operation and the quality of the plug.

SUMMARY

In one aspect, a technique that is usable with a well includes deploying a sensing device on a drill string and communicating with the sensing device during a plug cementing operation over a wired infrastructure of the drill string. The technique includes controlling the plug cementing operation in response to the communication.

In another aspect, a system that is usable with a well includes a pump system, a drill string that includes a wired infrastructure and a sensing device. The drill string includes a passageway to communicate fluids in connection with a plug cementing operation. The sensing device communicates a signal over the wired infrastructure during the plug cementing operation, and the signal is indicative of a state of the plug cementing operation.

In yet another aspect, an apparatus that is usable with a well includes a drill string that includes a wired infrastructure and a sensing device. The sensing device communicates a signal over the wired infrastructure during a plug cementing operation, and the signal is indicative of a state of the plug cementing operation.

Advantages and other features of the invention will become apparent from the following drawing, description and claims.

BRIEF DESCRIPTION OF THE DRAWING

FIGS. 5 and 6 depict a flow diagram illustrating a technique to deploy a cement plug in a well according to an example.

FIG. 7 is a block diagram of a sensor architecture according to an example.

DETAILED DESCRIPTION

Figure 1:
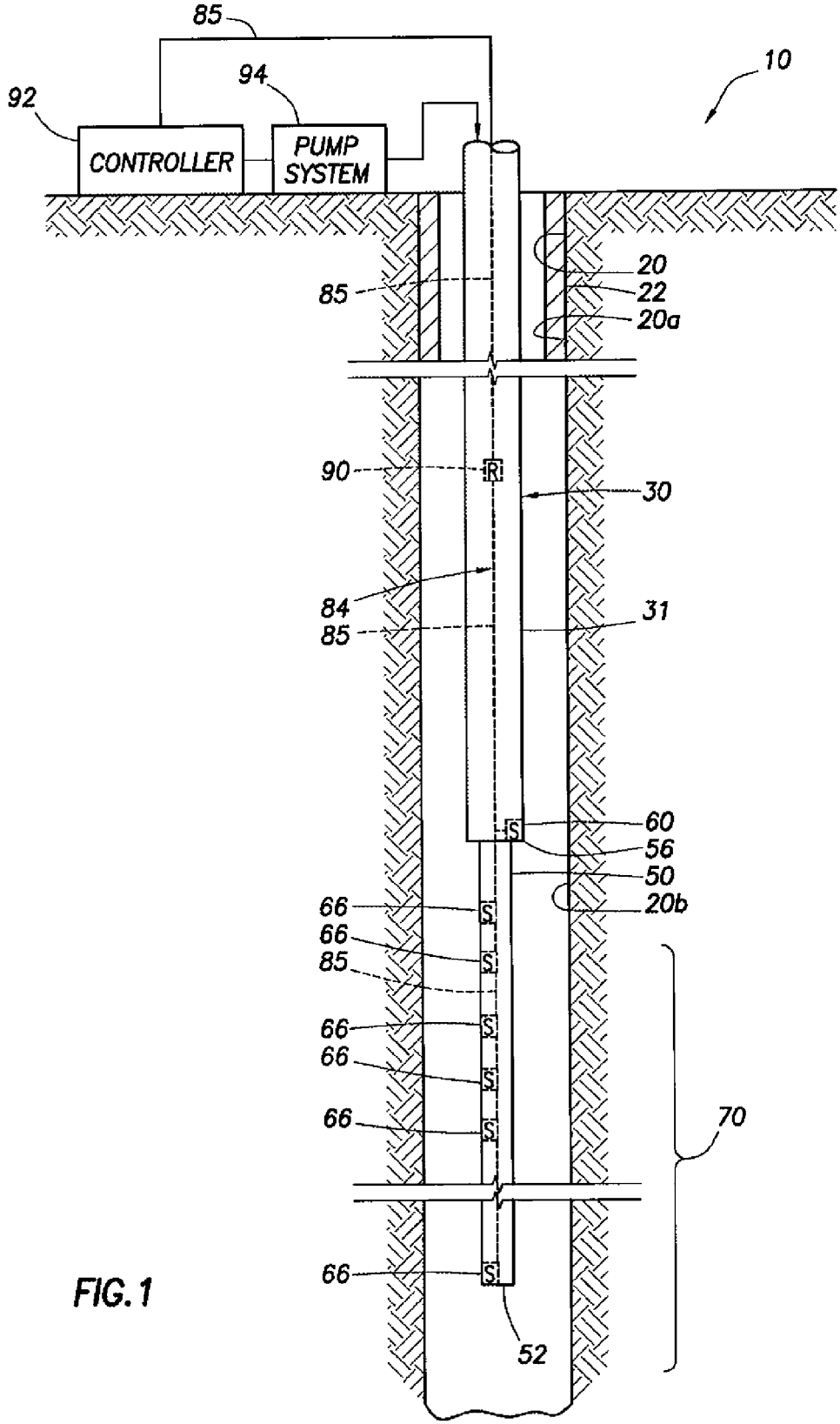
FIG. 1 is a schematic diagram of a system to deploy a cement plug in a well in a plug cementing operation according to an example.

Referring to FIG. 1, in an example, a system 10 for conducting a plug cementing operation in a well includes a drill string 30, which extends downhole into a wellbore 20 and includes a central passageway through which cement slurry and spacer fluids are communicated downhole in the plug cementing operation. As examples, the drill string 30 may be a coiled tubing or may be formed from jointed tubing sections. In general, the wellbore 20 may have an upper segment 20*a*, which is cased by a casing string 22 and a lower segment 20*b*, which is uncased. The examples disclosed herein set forth a balanced plug cementing operation, which is directed to deploying a cement plug in a targeted region 70 of the uncased wellbore segment 20*b*.

In general, the drill string 30 includes a larger diameter upper section 31 and a smaller diameter lower section, or tail pipe 50. During the plug cementing operation, a surface pump system 94 pumps the cement slurry through the central passageway of the drill string 30, and the cement slurry exits the drill string 30 at or near the tail pipe's lower end 52. For purposes of isolating the cement slurry from drilling fluid, the pump system 94 may pump fluid spacer layers into the string's central passageway, which precede and follow the cement slurry. Additionally, as further described below, the pump system 94 may pump drilling fluid downhole through the central passageway of the drill string 30 behind the fluid spacer and cement slurry layers to position the plug.

As a more specific example, the drill string 30 is initially positioned so that the lower end 52 of the tail pipe 50 is located in the targeted region 70. At this point, the wellbore 20 and the central passageway of the drill string 30 may be filled with drilling fluid. A viscous or reactive pill may be pumped down through the central passageway of the drill string 30 for purposes of providing a base for the cement plug to prevent its downward migration.

Next, the pump system 94 introduces a train of layers involved in the plug cementing operation. First, the pump system 94 introduces a first fluid spacer layer into the drilling string's central passageway. The first spacer fluid layer forms an isolation barrier to prevent the cement slurry, which follows the spacer fluid, from mixing with drilling fluid that is present in the drill string 30 and wellbore 20. The cement slurry follows the first spacer fluid layer, and a second spacer fluid layer is introduced into the central passageway of the drill string 30 behind the cement slurry. The pump system 94 then pumps drilling fluid into the drill string's central passageway to pump the train of spacer fluids and cement slurry downhole until the cement-spacer fluid interfaces are at the appropriate downhole positions, as further described below.

As described herein, for purposes of accurately controlling the plug cementing operation, such as detecting when the cement-spacer fluid interfaces are at the appropriate downhole positions, the drill string 30 has downhole sensors 60 and 66 and a wired infrastructure 84. The sensors 60 and 66 acquire downhole measurements that are indicative of the particular state of the plug cementing operation, and the measurements are communicated uphole over the wired infrastructure 84, which allows the plug cementing operation to be controlled in real time.

More specifically, as one example, the wired infrastructure 84 includes wire segments 85 and various repeaters 90 (one repeater 90 being shown in FIG. 1) that are integrated into the housing of the drill string 30. Thus, the drill string 30 contains a wired drill pipe (WDP) infrastructure. One example of a wired drill pipe is disclosed in U.S. Patent Application Publication No. 2006/0225962, filed by Madhavan, et al., and assigned to the assignee of the present application. As an example, the sensor 60 may be located slightly above the tail pipe 50 and in communication with the central passageway of the drill string 30 for purposes of detecting the arrival of the interface between the cement slurry and the second spacer fluid layer. As an example, the sensors 66 may be located along the tail pipe 50 for such purposes of detecting the interface between the first spacer fluid layer and the cement slurry layer and detecting any contamination of the cement slurry.

As one example, the wired infrastructure 84 and the downhole sensors 60 and 66 may be used to monitor and control a balanced plug setting operation. The fluids and material associated with the different stages of the balanced plug setting operation are illustrated in FIGS. 2, 3 and 4.

Figure 2:
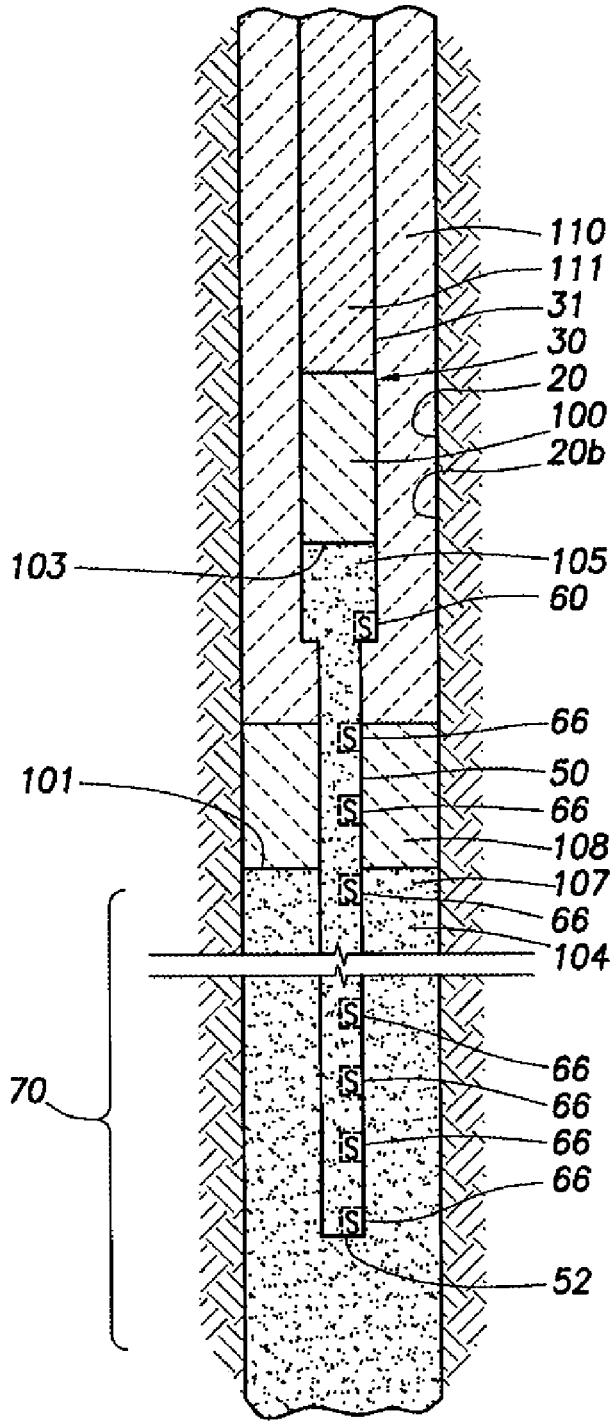
FIGS. 2, 3 and 4 are schematic diagrams depicting different states of the plug cementing operation according to an example.

FIG. 2 illustrates a stage of the balanced plug setting operation, which follows the above-described introduction of the train of spacer fluid layers and cement slurry into the well via the central passageway of the drill string 30. More specifically, in this stage, a first spacer fluid layer 108 has been pumped into the well through the central passageway of the drill string 30, exited the string near or at the end 52 and entered the annular region between the drill string and wellbore 20, called "an annulus 107." A pre-existing drilling fluid layer 110 is located above the first spacer fluid layer 108. Additionally, for this stage, a cement slurry has been introduced into the well behind the first spacer fluid 108 and forms a corresponding cement slurry layer 104 in the annulus 107, as well as a tubing cement slurry layer 105 that extends upwardly from the bottom end 52 and through the tail pipe 50 for this example. Also shown in FIG. 2 is a second spacer fluid layer 100 that is inside the drill string 30. The second spacer fluid layer 100 is located above the tubing cement slurry layer 105 and separates the layer 105 from a drilling fluid layer 111 that is located above the second spacer fluid layer 100 in the drill string 30.

Drilling fluid is pumped into the drill string 30 for purposes of forcing the second spacer layer 100 and tubing cement slurry layer 105 in a downward direction and forcing the annulus cement slurry layer 104 and first spacer fluid layer 108 in an upward direction. One of the final stages of the balanced plug cementing operation involves withdrawing the tail pipe 50 from the cement slurry, and ideally, when the tail pipe 50 is withdrawn, a cement-spacer fluid interface 103 (the interface between the tubing cement slurry layer 105 and the second spacer fluid layer 100) inside the string 30 is at the same position as a corresponding cement-spacer fluid interface 101 (the interface between the annulus cement slurry layer 104 and the first spacer fluid layer 108) outside of the drill string 30. In other words, the cement-spacer fluid interfaces 101 and 103 are ideally aligned when the tail pipe 50 is withdrawn, which prevents contamination of the cement slurry. Contamination of the cement slurry (such as mixing of the drilling fluid and cement slurry) may significantly degrade the mechanical properties of the cement plug and may cause the plug to fail.

Figure 3:
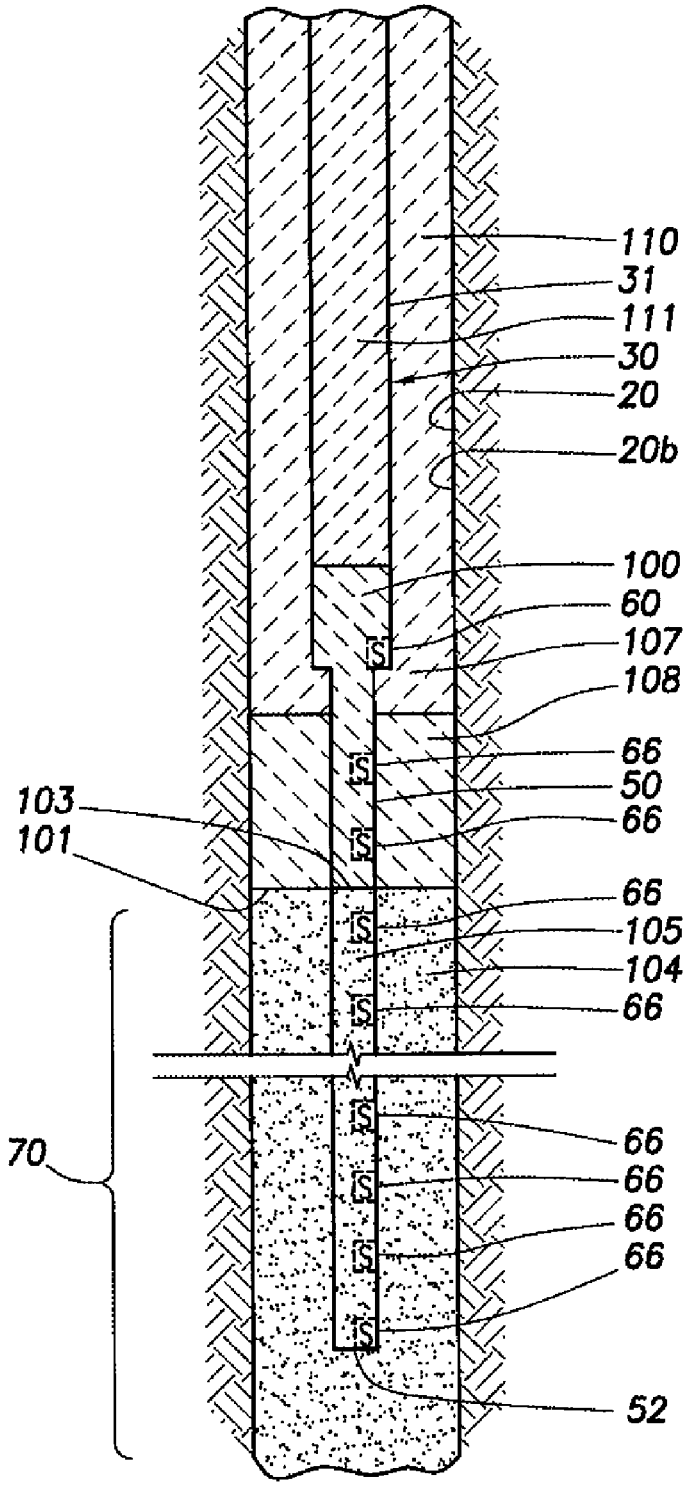
Figure 4:
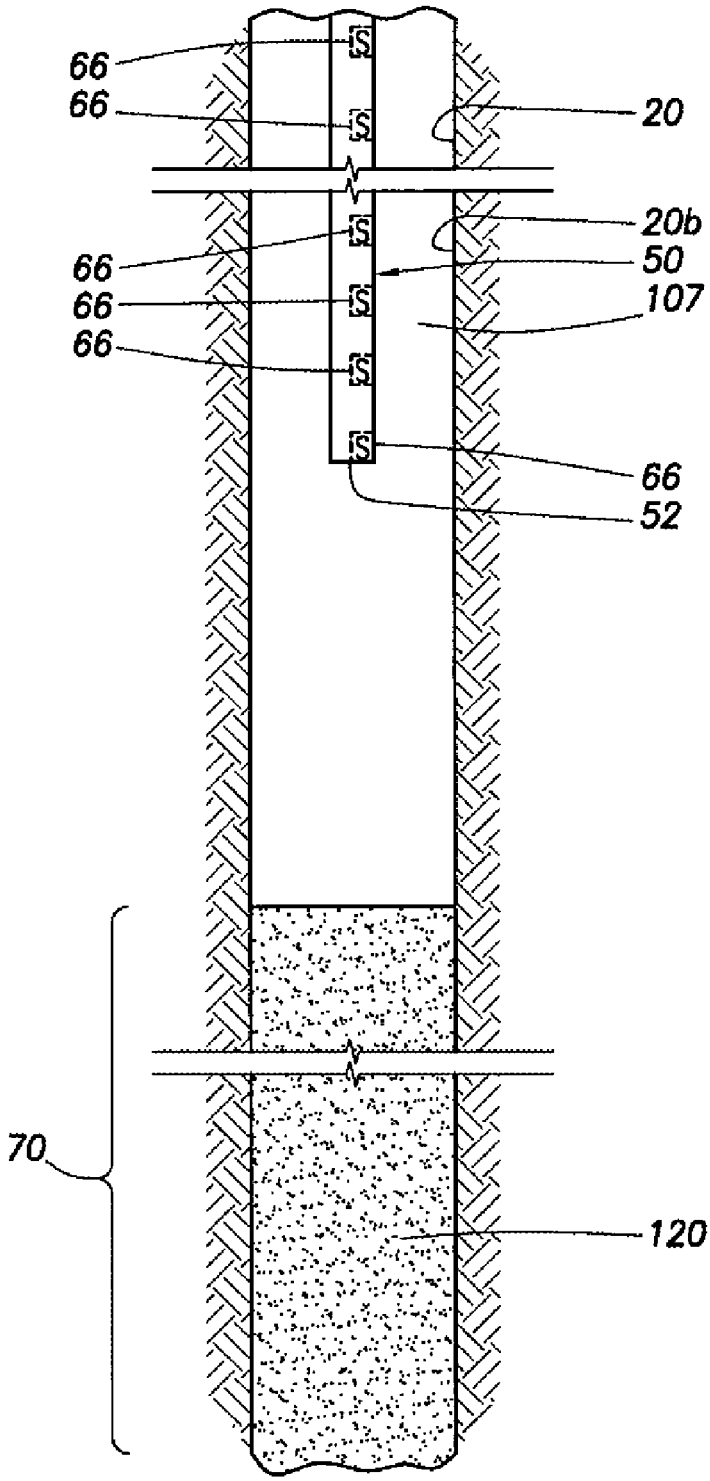

The above-described stage of the plug cementing operation in which the cement-spacer fluid interfaces 101 and 103 are aligned (i.e., are at the same vertical position) is depicted in FIG. 3. The cement-spacer fluid interfaces 101 and 103 align in a balanced state, which occurs when the hydrostatic pressure on the annulus cement slurry layer 104 outside of the drill string 30 is balanced with the hydrostatic pressure on the tubing cement slurry layer 105 inside the drill string 30.

When the cement-spacer fluid interfaces 101 and 103 align and hydrostatic balance is achieved, the tail pipe 50 may be withdrawn above the interfaces 101 and 103. When this occurs and if done at an appropriately slow rate (as further described), the cement slurry sets to form a cement plug 120 that is depicted in FIG. 4. Referring to FIG. 4, when the tail pipe 50 is a sufficient distance (100 feet, for example) above the top of the cement slurry layer, residual cement may be circulated out of the drill string 30.

A difficulty arises in determining when alignment of the cement-spacer fluid interfaces 101 and 103 (see FIGS. 2 and 3) is about to occur or has occurred. Therefore, the possibility exists that the cement-spacer fluid interfaces 101 and 103 may not be aligned when the tail pipe 50 is withdrawn from the cement slurry, if not for the sensors of the drill string 30. The non-alignment of the cement-spacer fluid interfaces 101 and 103 when the tail pipe 50 is withdrawn may cause contamination of the cement slurry (contamination with the drilling fluid, for example).

Referring to FIGS. 1 and 2, the sensor 60, which may be located slightly above the top end of the tail pipe 50, may be used to communicate (via the wired infrastructure 84) measurements to the surface of the well for purposes of detecting the arrival of the second spacer fluid layer 100 (i.e., detecting the arrival of the cement-spacer fluid layer interface 103). The sensor 60 may be located a sufficient distance above the desired top position of the cement plug for purposes of accounting for any delay that occurs between when the cement-spacer fluid interface 103 is detected and when the corresponding signal is received at the surface of the well. Upon receiving the signal, a controller 92 may be manually or automatically operated to cause the surface pumping system 94 to halt the pumping of drilling fluid downhole (and thus, halt the downward progress of the second fluid spacer layer 100 and tubing cement layer 105). More specifically, the pumping may be stopped when the cement-spacer fluid interface 103 is slightly above the interface 101, and thereafter, pumping ceases to allow the layers to fall under gravity to a position in which hydrostatic balance and alignment of the cement-spacer fluid interfaces 101 and 103 are achieved.

The other sensors 66 of the drill string 30 may likewise perform measurements outside and/or inside the tail pipe 50 to detect the position of the cement-spacer fluid interface 101, detect other layers and detect whether contamination of the cement slurry has occurred. Each of the sensors 66 may communicate its acquired measurements to the surface of the well via the wired infrastructure 84. As specific examples, the sensors 60 and 66 may be constructed to detect one or more of the following, which may be used to identify the fluid layers/materials: a density, a conductivity, a pressure, a radioactivity, a radio frequency (RF) tag (for scenarios in which particular layers or materials may contain RF tags that identify the layer/material), an optical property, and an acoustic property.

Figure 5:
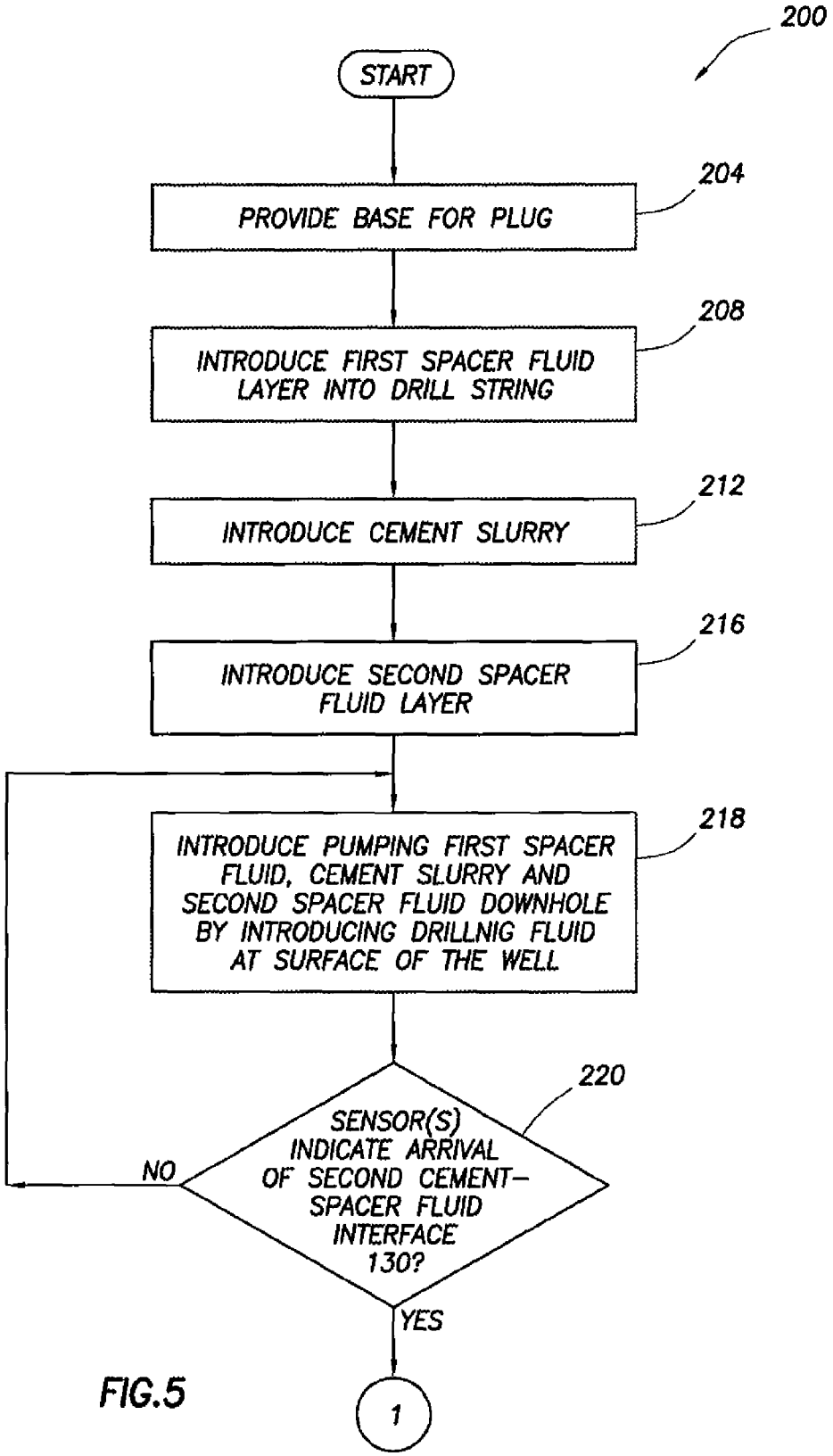

To summarize, FIGS. 5 and 6 depict a technique 200 to deploy a balanced cement plug in a well. According to the technique 200, a base is first provided (lock 204) for the plug. As examples, the base may be a mechanically-set plug or may be a plug that is formed from a viscous or reactive pill that is deployed downhole through the central passageway of the drill string. Next, the first spacer fluid layer is introduced Clock 208) into the drill string 30 and then the cement slurry is introduced (lock 212) into the drill string. Subsequently, the second spacer fluid layer is introduced (block 216) and pumping continues by introducing additional drilling fluid at the surface of the well, pursuant to block 218.

The pumping continues until one or more of the downhole sensors indicate (diamond 220) the arrival of the second cement-spacer fluid interface 103. Upon this occurrence, referring to FIG. 6, the withdrawal of the tail pipe from the cement column begins and continues, pursuant to block 224. If during the withdrawal, one or more of the sensors on the drill string 30 indicate mixing (pursuant to diamond 228) of the cement slurry (mixing with drilling fluid, for example), then the withdrawal speed of the tail pipe is reduced, pursuant to block 232 and control returns to block 224. Thus, using the downhole sensors, a control loop may be formed for purposes of controlling the speed at which the tail pipe 50 is withdrawn from the cement slurry.

If no mixing is indicated by the downhole sensors, then a determination is made (diamond 236) whether the sensor(s) indicate that the tail pipe 50 is above the cement slurry. Thus, the fluid composition that is indicated by the sensor(s) may be monitored until none of the sensors detect presence of the cement slurry. At this point, the tail pipe 50 is withdrawn (block 240) a predetermined distance (a distance of 100 feet, for example) above the top of the cement. Next, any residual cement in the drill string 30 is circulated out of the string 30, pursuant to block 244.

As an example, the sensor 60, 66 may have an architecture that is depicted in FIG. 7. This architecture includes a sensing element 250 that is constructed to sense such properties as density, conductivity, pressure, radioactivity, optical properties and/or acoustic properties. As another non-limiting example, the sensing element 250 may sense a tag that is embedded in the cement slurry, first spacer fluid, second spacer fluid, etc. In this regard, one or more of these layers may contain a unique RF tag to identify the layer and the associated interfaces. The sensing element 250 may be coupled to a telemetry interface 258. The telemetry interface 258 is connected to a wire segment 85 of the wired infrastructure 84 (see FIG. 1). The telemetry interface 258, based on the signals that are received from the sensing element 250, generates signals that are communicated over the wired infrastructure 84 to the surface of the well. These generated signals are indicative of the measurements that are acquired by the sensing element 250

As an example, the telemetry interface 258 may also establish a bi-directional interface, in that the telemetry interface 258 may receive signals communicated over the wired infrastructure 84 from the surface of the well. In this regard, as an example, the controller 92 may communicate commands downhole to instruct the various sensors regarding when and how to conduct the measurements.

Additionally, the sensor 60, 66 may include a controller 262 (one or more microprocessors and/or microcontrollers, as non-limiting examples), which may be constructed to coordinate the overall activities of the sensor 60, 66 as well as pre-process the measurement that is sensed by the sensing element 250, before the measurement is communicated uphole by the telemetry interface 258. Thus, many variations are contemplated and are within the scope of the appended claims.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method usable with a well, comprising:

deploying a sensing device on a drill string;

pumping a drilling fluid within the drill string;

pumping a first spacer fluid within the drill string above the drilling fluid;

pumping a cement slurry within the drill string above the first spacer fluid such that the first spacer fluid is positioned within the drilling fluid and the cement slurry, the first spacer fluid substantially preventing the drilling fluid from mixing with cement slurry;

communicating with the sensing device during a plug cementing operation over a wired infrastructure of the drill string; and controlling the plug cementing operation in response to the communication, wherein the communication includes an identification of an interface of the first spacer fluid and the drilling fluid or an interface of the first spacer fluid and the cement slurry at the sensing device.

2. The method of claim 1, wherein the communicating comprises communicating with the sensing device via a wired drill pipe infrastructure.

3. The method of claim 1, further comprising:

pumping a second spacer fluid into the drill string;

pumping a second cement slurry into the drill string; and using the sensing device to detect downhole an interface between the second cement slurry and the second spacer fluid.

4. The method of claim 1, further comprising:

communicating with at least one additional sensing device located on the string during the cementing operation; and further controlling the plug cementing operation in response to the communication with said at least one additional sensing device.

5. The method of claim 1, wherein the act of controlling comprises:

controlling pumping of fluid into the string.

6. The method of claim 1, wherein the act of controlling comprises:

controlling a rate at which the drill string is withdrawn from a cement slurry layer.

7. The method of claim 1, wherein the communicating comprises transmitting uphole an indication of a fluid property measurement acquired by the sensing device.

8. The method of claim 1, wherein the act of deploying comprises deploying the sensing device near an upper end of a tail pipe section of the drill string.

9. The method of claim 1, wherein the act of deploying comprises deploying the sensing device near a lower end of a tail pipe section of the drill string.

10. The method of claim 1, further comprising:

using the sensing device to measure a fluid property in an annulus that surrounds the drill string.

11. The method of claim 1, further comprising:

recirculating cement out of the pipe near a conclusion of the plug cementing operation.

12. The method of claim 1, wherein the plug cementing operation comprises a balanced plug cementing operation.

13. An apparatus usable with a well, comprising:

a drill string comprising a wired infrastructure;

a plurality of fluid layers within the drill string comprising at least a drilling fluid, a spacer fluid, and a cement slurry, wherein the spacer fluid is positioned between the drilling fluid and the cement slurry and further wherein the spacer fluid substantially prevents the cement slurry from mixing with the drilling fluid; and a sensing device to communicate a signal over the wired infrastructure during a plug cementing operation, the signal indicative of a position of a spacer fluid within the drill string wherein a second cement slurry and a second spacer fluid layer are introduced into the drill string and the sensing device further detects an interface between said second cement slurry and said second spacer fluid layer.

14. The apparatus of claim 13, wherein the string comprises a tail pipe section and the sensing device is attached to the tail pipe section.

15. The apparatus of claim 13, wherein the sensing device is adapted to sense a radio frequency tag, a density, a conductivity, a pressure, a radioactivity, an optical property or an acoustic property.

16. A method for performing a plug cementing operation, comprising;

step for pumping a drilling fluid into a wellbore;

step for pumping a spacer fluid into the wellbore above the drilling fluid;

step for pumping a cement slurry into the wellbore such that the spacer fluid is positioned between the cement slurry and the drilling fluid and substantially prevents mixing of the drilling fluid and the cement slurry;

step for detecting an interface between the spacer fluid and the cement slurry within a drill string and exterior to the drill string;

step for communicating data to a surface indicative of alignment of the interface within the drill string is aligned with the interface exterior to the drill string; and step for automatically halting pumping at alignment of the interfaces.

17. The method of claim 16 further comprising measuring a fluid property in an annulus that surrounds the drill string.

18. The method of claim 16 further comprising controlling a rate at which the drill string is withdrawn from a cement slurry layer.

19. The method of claim 16 wherein the drill string comprises jointed tubing sections.

20. The method of claim 16 wherein the drill string comprises coiled tubing.

* * * * *